United States Patent [19]

Pierret et al.

[11] Patent Number: 5,046,220

[45] Date of Patent: Sep. 10, 1991

[54] METHOD FOR FEEDING FIBRES TO A FIBRES CUTTING MACHINE AND FIBRE CUTTING MACHINE FOR IMPLEMENTING SUCH METHOD

[76] Inventors: Hubert Pierret, Rue du Tambour, 29; Gabriel L. Pierret, Rue du Tambour, 33; Maurice J. Pierret, Rue de l'Eglise, 15; Jean-Marie M. Pierret, Rue du Sommet, 14, all of, 6838 Corbion, Belgium

[21] Appl. No.: 474,101

[22] Filed: Apr. 2, 1990

[30] Foreign Application Priority Data

Oct. 2, 1987 [BE] Belgium ..... 08701125

[51] Int. Cl.[5] ..... D01G 1/04

[52] U.S. Cl. ..... 19/0.6; 83/276; 83/913

[58] Field of Search ..... 19/0.6; 83/276, 906, 83/913

[56] References Cited

U.S. PATENT DOCUMENTS

| | | | |
|---|---|---|---|
| 744,328 | 11/1903 | Frtschek | 83/276 X |
| 3,162,080 | 12/1964 | Hemker | 83/355 |
| 3,334,533 | 8/1967 | Davis, Jr. | 83/913 |
| 3,479,911 | 11/1969 | Galkin | 83/276 X |
| 3,728,922 | 4/1973 | Off | 83/276 X |

FOREIGN PATENT DOCUMENTS

| | | | |
|---|---|---|---|
| 559838 | 3/1952 | Canada | 83/273 |
| 1457318 | 11/1966 | France . | |
| 2391821 | 12/1978 | France . | |
| 259524 | 4/1964 | Netherlands | 83/276 |

*Primary Examiner*—W. C. Reynolds
*Assistant Examiner*—John J. Calvert
*Attorney, Agent, or Firm*—Cushman, Darby & Cushman

[57] ABSTRACT

A process for feeding fibres towards the fixed and mobile knives of a fibre cutter, such as a flock cutter, is provided which includes preparing a mattress of fibres aligned in a direction which is substantially perpendicular to the vertical plane of the knife so that the mattress of fibres takes the form of a band. The band is conveyed in a step-by-step manner towards the knives while supporting the band adjacent the fixed knife so that its lower face and its lateral side faces are supported by planer support surfaces having a dimension significant in relation to the length of sections of fibres being cut. The step-by-step conveying is effected by bringing the band to a temporary standstill in relation to the support surfaces as the fibres are advanced towards the cutter.

18 Claims, 4 Drawing Sheets

METHOD FOR FEEDING FIBRES TO A FIBRES CUTTING MACHINE AND FIBRE CUTTING MACHINE FOR IMPLEMENTING SUCH METHOD

BACKGROUND AND SUMMARY OF THE INVENTION

1. Field of the Invention

The invention relates to an apparatus process for feeding fibres in the direction of the fixed and mobile knives of a fibre cutter, in particular of a flock cutter.

2. Description of the Related Art

In known cutters, the fibres are fed in the direction of the knives by being pinched between smooth cylinders which extend transversely to the direction of travel of the fibres and rotate about their longitudinal axes. The cylinders are brought to a temporary standstill when the fibres are cut.

Such known cutters have the disadvantage that they fail to ensure regular feed of the fibres because the fibres are pinched by the cylinders only in the vicinity of their contact points with the cylinders and some slipping of the fibres in relation to the cylinders is unavoidable. Furthermore, the mattress or band of fibres being fed is free along its lateral edges. These irregularities in fibre feeding may be of little significance in fibre cutters that are cutting fibres into sections of great length but are unacceptable in flock cutters where the length of the fibre sections cut is generally less than 1 mm.

SUMMARY OF THE INVENTION

It is an object of the invention to overcome the foregoing drawback of conventional cutters by providing a process which allows for extremely accurate feeding of the fibres. Thus the invention is particularly applicable to flock cutters. With the process of the invention, the fibres do not slip relative to one another over the entire section of the fibre band or mattress. Thus the sections which are cut will be of equal length and will remain constant during the course of cutting.

The process of the invention includes preparing a mattress of fibres aligned in a direction which is substantially perpendicular to the vertical plane of the edge of the fixed knife of the fibre cutter so that the mattress of fibres is in the form of a band. The band is conveyed step-by-step towards the knives and is supported in the vicinity of the fixed knife so that its bottom face and lateral faces are each supported by a surface. The surface supporting the bottom face and lateral faces of the band is great when compared to the length of the fibre sections to be cut which may be as small as 0.1 mm. The band is conveyed step-by-step towards the knives by gripping the band between contacting surfaces, advancing those surfaces and the band toward the knives by an amount equal to the length of the fibre sections to be cut. The band is brought to a temporary standstill, clamped between the support surfaces so that a portion of the band extends between the mobile and fixed knifes. The knife then sever the band of fibres after which point the band is released by the supporting surfaces and those surfaces are displaced so as to move away from the knife to again grip the band and advance it towards the knife.

In accordance with a preferred embodiment of the invention, the mobile knife and movement of the surface areas are controlled so as to operate in synchrony.

The invention also resides in a cutter with which the aforementioned process can be practiced.

The cutter comprises a fixed knife which is detachably coupled to a support and a mobile knife which is also detachably coupled to a support. A substantially horizontal fixed support is further provided which is located at substantially the same level as the edge of the fixed knife of the cutter. The band of fibres is adapted to rest on the horizontal fixed support. A mobile support is also provided which is substantially U-shaped as seen in a plane perpendicular to the longitudinal centerline of the band of fibres. The inner faces of the mobile support provide surface areas that support the bottom face and lateral faces of the band and are configured so as to define an extension of the end of the fixed support which is closest to the fixed knife. A movable plate is further provided in parallel with the base of the U-shaped mobile support. The mobile plate is mounted so as to be movable towards and away from the fixed knife, substantially in parallel to the base of the mobile support and vertically between the legs of the U-shape mobile support.

The cutter also includes means for driving the mobile knife continuously so that it cooperates with the fixed knife according to a cycliced movement. Means are provided for driving the mobile support in an alternate movement in a direction substantially parallel to the longitudinal centerline of the band. The mobile plate is correspondingly driven in a alternating manner. The means for driving the mobile support and the mobile plate are in synchrony with the means for driving the mobile knife so that in the course of one cycle of the mobile knife, the mobile support is driven so as to effect reciprocating movement between two extreme positions, one in which it is spaced from fixed knife and the second in which it is relatively close to the fixed knife. The distance separating the extreme positions of the support is equal to the length of the sections of fibres to be cut by removable knife. The mobile plate moves towards the knife by a similar amount during one cycle of the knife. Thus the mobile plate accompanies the mobile support in its movement when it passes from its first, spaced position to its second, adjacent position as it rests on the top face of the band. The mobile plate also accompanies the mobile support when it passes from its second, close position to its first, spaced position, but is spaced from the top face of the band.

Other objects, features, and characteristics of the present invention as well as the methods of operation and functions of the related elements of structure, and the combination of parts and economies of manufacture, will become more apparent upon consideration of the following description and the appended claims with reference to the accompanying drawings, all of which form a part of this specification, wherein like reference numerals designate corresponding parts in the various figures.

DETAILED DESCRIPTION OF THE INVENTION

Figure 1:
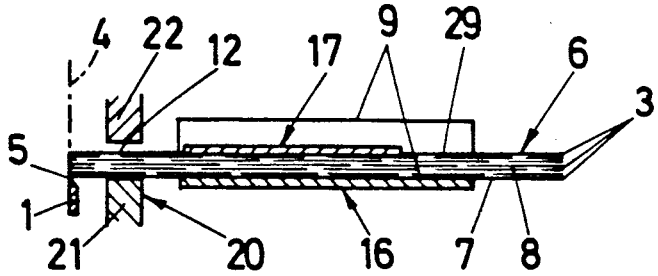
FIGS. 1–7 are schematic side views showing successive phases of the process according to the invention in the course of one cutting cycle.

The process of the invention has the object of feeding fibres in the direction of fixed 1 and mobile 2 knives of a fibre cutter, in particular a flock cutter. The process resides in particular in preparing a mattress of fibres 3 that are aligned according to a direction substantially perpendicular to the vertical plane passing through edge 5 of fixed knife 1 so that the mattress presents itself in the form of a band 6. The band is conveyed toward the knife in a step-by-step manner by supporting and moving the band to a point adjacent fixed knife 1. The band is conveyed while its bottom face 7 and lateral faces 8 are supported by a planer surface 9 having a dimension parallel to the direction of conveyance which is significant as compared to the length of sections 10 of fibres to be cut which is on the order of 0.1 mm. Step-by-step conveying and cutting are effected by bringing band 6 to a temporary standstill in relation to supports 9 in order to prevent slippage of fibres 3 during conveyance of support surfaces 9 toward the cutters by an amount equal to the length of the sections 10 of the fibres to be cut.

Figure 2:
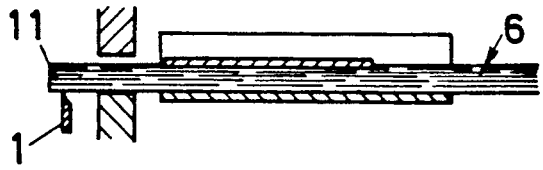
Figure 3:
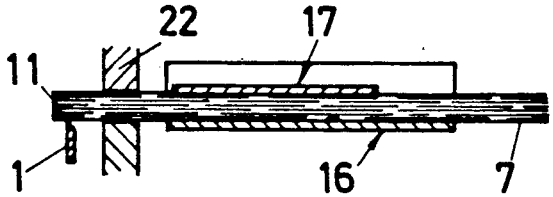
Figure 4:
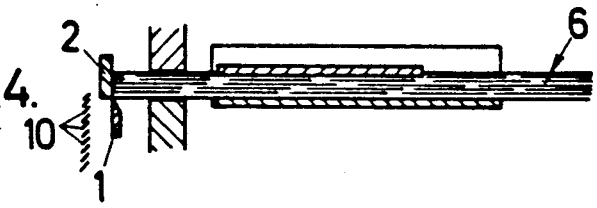
Figure 5:
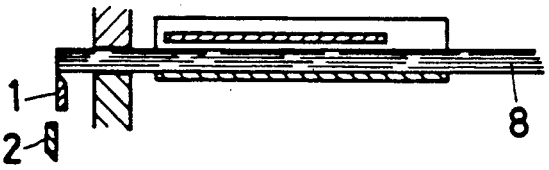
Figure 6:
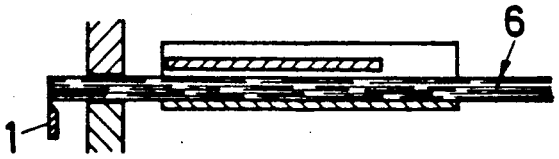
Figure 7:
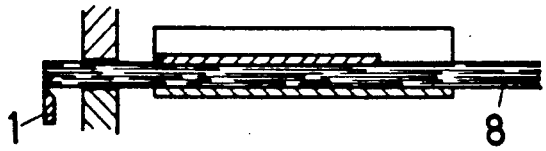

Considering as a starting point the position wherein the mobile knife 2 is spaced from band 6 and support surfaces 9 which support band 6 are in their position farthest from fixed knife 1 (FIG. 1), the conveying and cutting process of the invention is effected as follows. First, the band 6 is held fixed relative to support surfaces 9, clamped therebetween. The support surfaces 9 are then moved in the direction of fixed knife 1 in order to move downstream one band portion 11 which has a length equal to the length of sections 10 (FIG. 2). The band comes to a temporary standstill in a zone 12 located between the trajectory of mobile knife 2 and support surfaces 9. Support surfaces 9 have then reached as shown in FIG. 3 their position closest to fixed knife 1 and the band is cut with mobile knife 2 (FIG. 4). Band 6 is then released by the support surfaces 9 and the support surfaces 9 are displaced away from the knife (see FIG. 6).

According to the invention, band 6 is fixed in relation to the support surfaces 9 by applying a pressure distributed regularly over the top surface area 29 of the band whereas the band is held in zone 12 by pinching the band by bearing on the bottom 7 and top 29 faces of the band. In accordance with the process of the invention, the amplitude of the alternating movement of support surfaces 9 can be set as a function of the length of the fibres to be cut and the clamping of the band with respect to support surfaces 9 as well as in zone 12 can be set as a function of the thickness of the band.

Band 6 is prepared so that its width substantially corresponds to the distance between the surface areas 9 provided to support its lateral faces 8. In order to optimize the performance of the cutter, this distance that separates surface areas 9 is chosen so as to be slightly less than the length of knives 1 and 2. The alternating movement of surface areas 9 causes band 6 to advance step-by-step towards the cutter and the temporary standstill of the band in relation to the support surface areas 9 as well as the temporary standstill in zone 12 is controlled in synchrony with the drive of the mobile knife.

Because of the high rates of the cutters, significant heating occurs at knives 1 and 2. This heating can be such that it may agglomerate and weld some fibres which are made of synthetic material. In order to prevent this undesirable result, in accordance with the process with the invention, permanent cooling of supports 13 and 14 of the fixed 1 and mobile 2 knives is provided. These supports are chosen so as to provide a large contact surface area with their knives.

The fibre cutter provided in accordance with the invention comprises one fixed knife 1 and one mobile knife 2 that are respectively detachably coupled to support 13 and support 14. A fixed support 15 which is substantially horizontal is further provided and the band 6 of fibres to be cut rests thereupon. Support 15 aligns the fibres so as to extend substantially in parallel with the direction in which the band is moving in the cutter and it is located at substantially the same level as the upper edge of the fixed knife of the cutter.

A mobile support which is substantially U-shaped in cross-section is further provided, the inner faces of which constitute the surface areas 9 for supporting the bottom face 7 and lateral faces 8 of the band 6. The movable support is arranged as an extension of the end of the fixed support 15 which is closest to the fixed knife and is substantially at the same level as the edge 5 of the fixed knife. The cutter further includes a mobile plate 17 located at a level higher than the level of mobile support 16 and substantially in parallel with the base of the U-shaped mobile support 16. The surface area of mobile plate 17 is slightly smaller than the surface area of the base 18 of the U-shape support so that plate 17 is capable of moving in a plane parallel to that of the mobile support 16 between the legs 19 of the U-shape support.

The cutter even further comprises in the zone 12 a claw 12 located between the mobile support 16 and fixed knife 1 which consists of two chucks 21 and 22 that are parallel and extend transversely to the longitudinal centerline of band 6. The chuck 21 is fixed and arranged substantially at the same level as the edge 5 of fixed knife 1 whereas chuck 22 is movable in a direction substantially parallel to the vertical plane 4. The band is located between chucks 21 and 22 and passes between mobile plate 17 and mobile support 16. The cutter further comprises means 23 such as a motor 24 for driving a rod/crank system 25 for driving mobile knife 2 continuously so as to cooperate with the fixed knife 1 according to a cyclic movement. Means 26 are provided for driving mobile support 16 in an alternating movement according to a direction substantially parallel with the longitudinal centerline of band 6. Temporary standstill of band 6 in relation to surface areas 9 and in zone 12 is made possible by means 27 for alternatingly moving mobile plate 17 in a direction perpendicular to the longitudinal centerline of band 6 and in a direction parallel to that centerline. Furthermore means 28 is provided and designed to drive the mobile chuck 22 of claw 20 in a direction substantially perpendicular to the longitudinal centerline of band 6 thus means 26, 27 and 28 that respectively drive the mobile support, the mobile plate, and movable chuck 22 of claw 20 are synchronized with the driving means 23 of the mobile knife. Means 26, 27 and 28 are so designed, furthermore, that in the course of one cycle of mobile knife 2, that is between each pass of mobile knife 2 in front of fixed knife 1, mobile support 16 is driven to effect a reciprocating movement between two extreme positions. The second position of the reciprocating movement is close to fixed knife 1 and whereat it can be kept at a standstill during the cutting of band 6. The first position is spaced from the fixed knife. The distance between the first and second positions of mobile support 16 is substantially equal to the length of the sections 10 of the fibres to be cut.

Means 26, 27 and 28 are provided so that on the one hand mobile plate 17 accompanies mobile support 16 in its movement when it passes from its first position to its second position, while resting on top face 29 of band 6. Furthermore, mobile plate 17 accompanies the mobile support as it passes from its second position to its first position while spaced from the top face 29 of the band. Means 26, 27 and 28 are also provided so that mobile chuck 22 of claw 20 rests on the top face 29 of the band as soon as mobile support 16 reaches its second position, during the standstill of mobile support 16 in that second position and while the mobile support is passing from its second position to its first position. Mobile chuck 22 of claw 20 is spaced from the top face 29 of the band as soon as mobile support 16 reaches its first position and plate 17 again rests on top face 29 of band 6. The mobile chuck of claw 20 is also spaced from top face 29 as support 16 passes from its first position to its second position with plate 17 resting on top face 29 of the band.

The fibre cutter according to the invention further includes means 30 for setting the amplitude of the alternating movement of mobile support 16 as a function of the length of the sections of fibres to be cut. Means 30 are designed to maintain the amplitude of the alternating movement constant after it has been set. Thus means 30 include a fixed stop 31 (FIG. 8) having a position which can be adjusted when the cutter is being assembled and adjusted to determine the second extreme position of mobile support 16 by limiting its travel in the direction of fixed knife 1. Travel of mobile support 6 is brought about under the pressure of spring 57 irrespective of the length of sections 10 of the fibres to cut. An eccentric 56 which has an eccentricity that can be adjusted as a function of the length of sections 10 of the fibres to be cut is provided to act upon support 16 against spring 57 in order to bring the support to its first extreme position.

Figure 9:
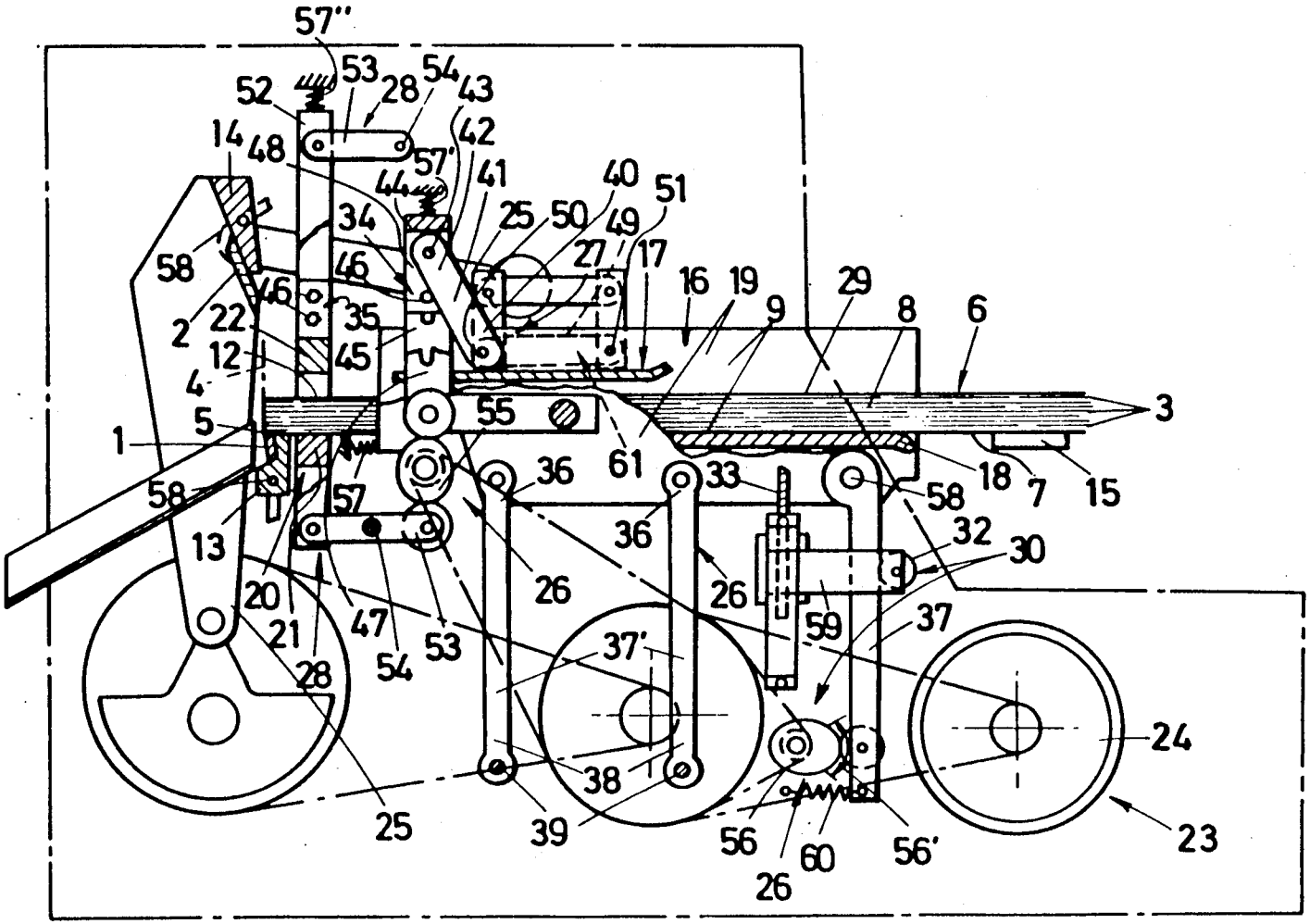
FIG. 9 is a partial view similar to FIG. 8 and showing a variant of the cutter illustrated in FIG. 8.
Figure 10:
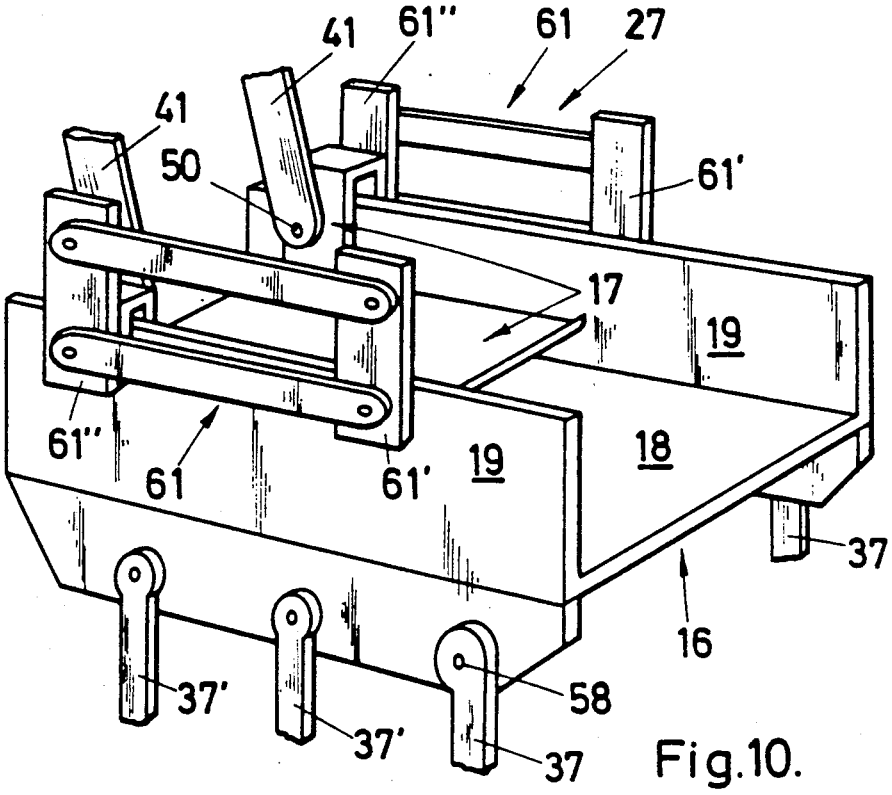
FIG. 10 is a perspective view with parts broken away for clarity showing details of the cutter illustrated in FIG. 9.

In the form of embodiment of the cutter illustrated in FIG. 9, the means 30 for adjusting the amplitude of the alternating movement of the mobile support 16 comprises two levers 37 hinged to the support 16, symmetrically in relation to the longitudinal centerline of the band 6, two fixed stops 32 that are co-operating each with a lever 37 and the position of which is adjustable as a function of the length of the sections 10 of the fibres to be cut, against which the levers 37 are being pushed by springs 57 as well as two cams 56 that are acting upon these levers 37. The stops 32 and the cams 56 are located on both sides of the levers 37 and these stops 32 are located between the hinges 58 and the levers 37 on the support 16 and the aforesaid cams 56. Springs 60 are provided to maintain the levers 37 applied constantly against the cams 56. Each of the fixed stops 32 consists of a roller, the axle of which is carried by an arm 59 that can be displaced, for the purpose of setting the position of the roller, according to a vertical direction under the action of means such as a micrometer ratchet 33. The micrometer ratchets which control the two arms 59 that support the two stops 32, are coupled so as to be controlled simultaneously from one single control unit (not shown). The axles of the rollers that constitute the fixed stops 32 are, in the inactive position of the cams 56 and whatever the position of the rollers as a function of the length of the sections of fibres to be cut may be, located in a plane parallel with the plane that passes via the longitudinal centerline of the levers 37.

In addition to the means 30 that adjust the amplitude of movement of the support 16, the cutter according to the invention comprises means 34 designed so as to set the position of the mobile plate 17 in relation to the mobile support 16 and means 35 for setting the distance that may separate the mobile chuck 22 of the claw 20 from the fixed chuck 21, as a function of the thickness of the band 6 of fibres conveyed step-by-step by the mobile support 16.

Figure 8:
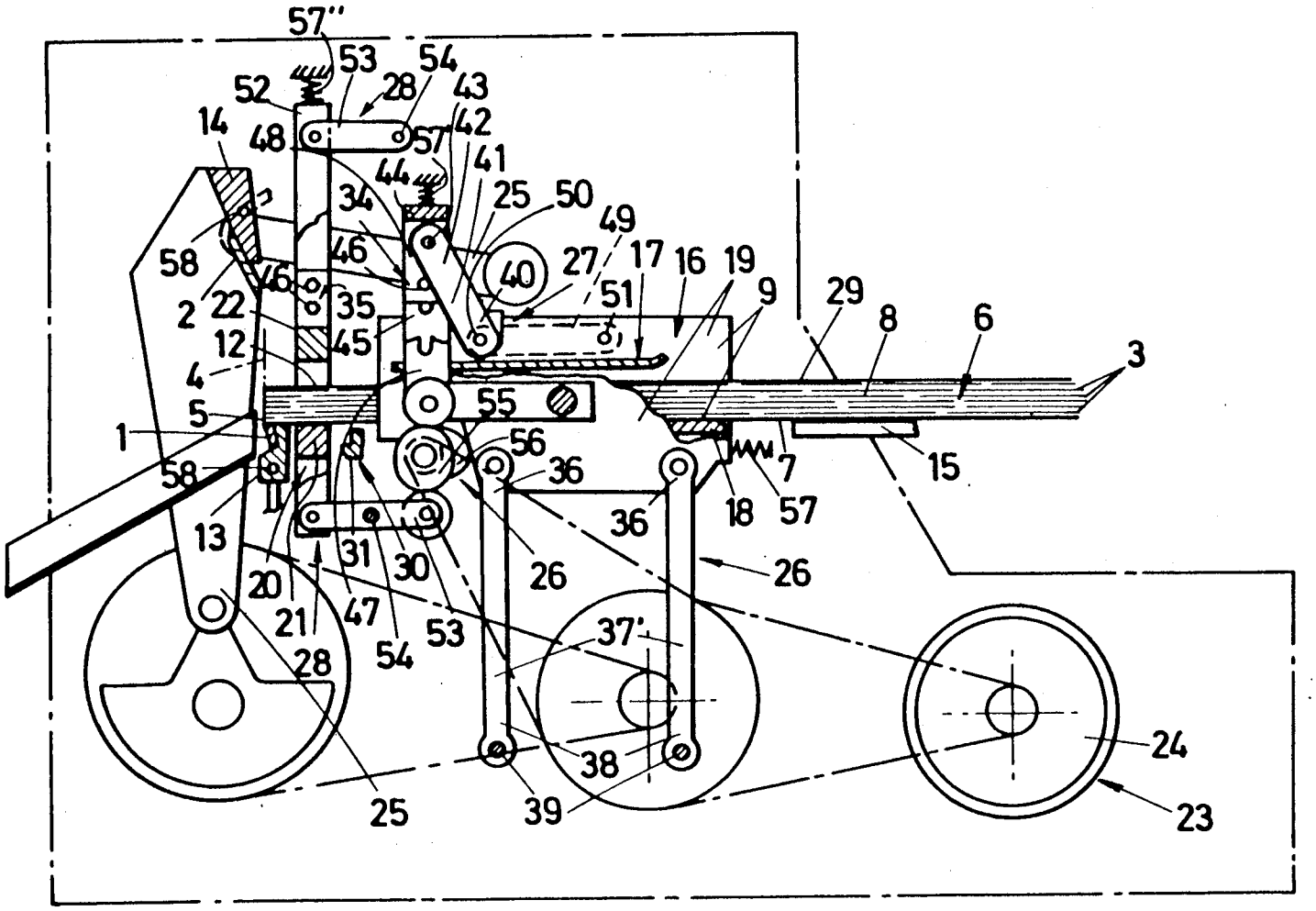
FIG. 8 is a schematic side view showing a cutter for applying the process of the invention.

In the embodiment of the cutter illustrated in FIGS. 8 and 9, the mobile support 16 is supported and hinged so as to be able to be driven in a practically horizontal movement, at the ends 36 of rods 37' which are part of the aforesaid means 26, which have their other ends 38 assembled, pivoting freely, on fixed spindles 39, the centerline of which are extending perpendicularly to the direction of displacement of the mobile support 16.

In the embodiment illustrated in FIG. 8, the mobile plate 17 is suspended and hinged to the ends 40 of a first set of cranks 41 whose other ends 42 are hinged around an axle 43 in parallel with the spindles 39, on the cross girder 44 of a crossbar 45 installed above the mobile support 16. The crossbar 45 is mobile in a more or less vertical direction and the cross girder 44 is adjustable in height through means 34. Means 34 consist of screws 46 that allow for immobilizing, in the position chosen, the two parts 47 and 48 that constitute each the uprights of the crossbar 45. The mobile plate 17 is, furthermore, secured to the mobile support 16 via a second set of cranks 49 hinged, in 50, to the mobile plate 17 and, in 51, to the legs 19 of the U-shape that constitutes this support 16 around axles parallel with those of the first set of cranks, with these two sets of cranks 41 and 49 being part of the aforesaid means 27. In the embodiment of the cutter illustrated in FIG. 9, the mobile plate 17 is suspended and hinged to the ends 40 of a set of cranks 41, the other ends of which are hinged around an axle 43, in parallel with the aforesaid spindles, on a crossbar 44 mobile in a more or less vertical position, adjustable in height and arranged above the mobile support 16, so as to remain constantly in parallel with the core 18 of the U-shape formed by the mobile support 16. The mobile plate 17 is also secured to the mobile support 16 via a set of deformable parallelograms 61 of axles parallel with those of the set of cranks 41, two parallel elements 61' and 61'' of each of these deformable parallelograms being fitted, respectively, perpendicularly to the core 18 of the aforesaid U-shape and symmetrically in relation to the longitudinal centerline of the band 6, to one of the legs 19 of the U-shape and to the mobile plate 17. As to the mobile chuck 22 of the claw 20, it is being supported at its ends and adjustably in height, by a frame 52 that is mobile in a more less vertical direction, supported and controlled by cranks 53 that have centerline in parallel with the spindles 39 and that are part of the means 28, hinged to fixed pivots 54.

The means 26, 27 and 28 also comprise, for the purpose of bringing about the movements of the mobile support 16, of the crossbar 45 that supports the mobile plate 17 and of the frame 52 that supports the mobile chuck 22 of the claw 20, in order to move the mobile support 16 from its second to its first extreme position, in order to displace the crossbar 45 so that the mobile plate 17 is removed form the top face 29 of the band 6 held by the mobile support 16 and in order to move the frame 52 so that the claw 20 opens, through cams wedged to one and the same shaft (FIG. 8) and wedged to parallel shafts (FIG. 9) driven in rotation around their centerline from driving means 23 of the mobile knife 2, in synchronization with the latter, and acting either upon the aforesaid levers 37 (FIG. 9) or upon the mobile support 16 (FIG. 8), at the crossbar 45 and at the frame 52, with the movements of the aforesaid mobile support 16, crossbar 45 and frame 52 taking place in the opposite direction when they are not longer being prompted by the cams and to return the aforesaid mobile support 16 to its second extreme position (FIG. 8) and to its first extreme position (FIG. 9), with the mobile plate 17 resting on the top face 29 of the band 6 and the claw 20 in closed position, under the action of recuperating springs 57, 57' and 57".

In order to ensure cooling, the knives 1 and 2 for the purpose of preventing any gluing or welding of the fibres, supports 13 and 14 of the fixed and mobile knives are so designed as to have large contact surface areas with the knives and the supports 13 and 14 are pierced each by at least one canal 58 that extends according to the length of the support and that is designed to let a coolant fluid flow through. Means (not shown) here are provided for conveying the coolant fluid to one of the ends of the canals 58 arranged in the supports as well as for collecting the fluid at the other end of the canals and for having the aforesaid coolant fluid circulate, preferably continuously, through the canals 58.

Figure 11:
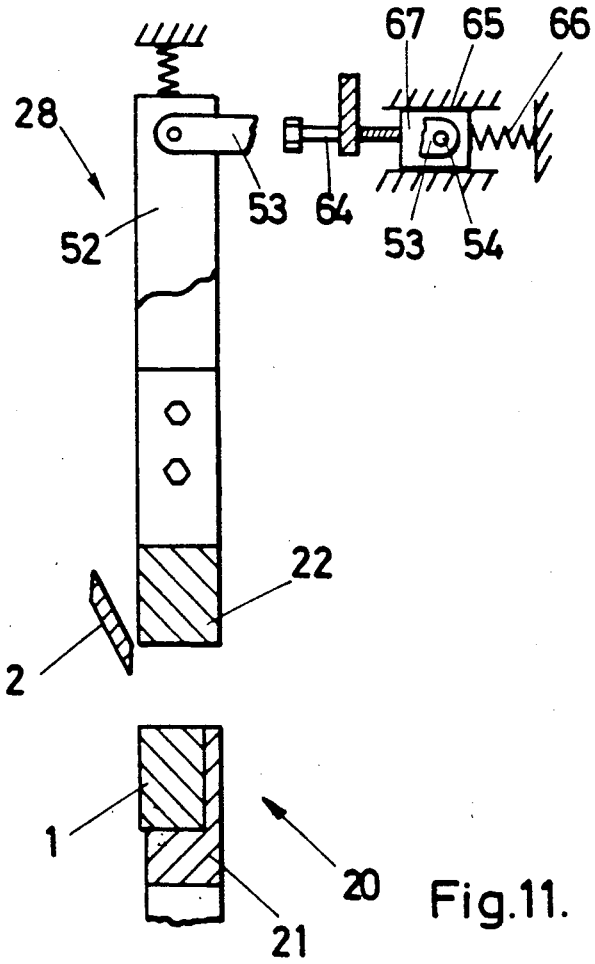
FIG. 11 is a partial view showing details of the claw of the invention.

As shown in FIG. 11, the pivots 54 to which the cranks 53 are hinged are advantageously adjustable in position, according to a direction parallel with the longitudinal centerline of the band 6 in order to be able to adjust the position of the mobile chuck 22 of the claw 20 so that it is located as close as possible to the trajectory of the mobile knife 2, in such a manner as to bring the band to a standstill in the direct neighborhood of the knives 1 and 2 and to change the position of the aforesaid mobile chuck 22 as the fixed knife 1 become increasingly worn. This adjustment of the pivots 54 is achieved by acting upon the screws 64 that are moving in fixed slides 65, against springs 66, with slide blocks 67 carrying the pivots 54.

While the invention has been described in connection with what is presently considered to be the most practical and preferred embodiment, it is to be understood that the invention is not to be limited to the disclosed embodiment, but on the contrary is intended to cover various modifications and equivalent arrangements included within the spirit and scope of the appended claims.

We claim:

1. A process for feeding fibres in the direction of a fixed knife and a mobile knife of a fibre cutter, comprising:

providing a band of fibres aligned in a direction substantially perpendicular to a vertical plane passing through an edge of the fixed knife;

providing a mobile support and a mobile plate mounted in parallel spaced apart relation, each having a horizontal support surface substantially parallel to a plane of said band of fibres, said mobile support being substantially U-shaped in cross-section having a base for engaging one of a top and a bottom surface of said band of fibres and first and second lateral supports for engaging lateral surfaces of said band of fibres, the surface area of the mobile plate and the surface area of the mobile support in contact with the band of fibres being substantially greater than a length of fibres to be cut by the mobile and fixed knives;

providing means for driving one of said mobile plate and mobile support towards and away from the other of said mobile plate and mobile support and reciprocally towards and away from said fixed and movable knives from a first position, spaced from said knives, to a second position adjacent said knives;

providing means for driving the other of said mobile plate and said mobile support reciprocally towards and away from said fixed and mobile knives from a first position, spaced from said fixed and mobile knives, to a second position adjacent said knives;

providing claw means disposed between said mobile support and said knives, said claw means comprising two parallel chucks extending transversely to a longitudinal centerline of sad band of fibres, one of said chucks being fixed and being disposed substantially at the same level as said edge of said fixed knife, said band being disposed so as to move horizontally between said two chucks;

providing means for alternatingly moving the mobile chuck of the claw means in a direction substantially perpendicular to the longitudinal centerline of the band so as to selectively pinch the band between the mobile and stationary chucks;

providing means for reciprocally driving said mobile knife towards and away from said fixed knife so as to periodically cooperative with said fixed knife to cut fibres therebetween; and driving the mobile support, mobile plate and mobile chuck in synchrony so that when said mobile plate and said mobile support are each at their first position, said one of said mobile plate and mobile support is moved towards the other to clamp the band therebetween, the mobile chuck is moved away from the stationary chuck, the mobile plate and mobile support are thereafter advanced together from the first positions thereof to the second positions thereof, the mobile chuck moves towards the stationary chuck to clamp the band therebetween, the mobile knife can move to cut the fibres disposed between the mobile knife and the fixed knife while the band is held at a standstill by at least one of said claw means and said mobile plate and support, one of the mobile plate and mobile support is moved away from the other and the mobile plate and mobile support are returned to their first positions, with the mobile plate and mobile support spaced apart, whereupon the driving process is repeated.

2. A process according to claim 1, wherein the amplitude of the alternating movement of said support surfaces is a function of the length of the sections of fibres to be cut in the fibre cutter.

3. A process according to claim 1, wherein the clamping of said band in relation to said support surfaces that are supporting it, and the clamping of said band in said holding zone, are a function of a thickness of said band.

4. A process according to claim 1, wherein the movement of said support surfaces, the clamping of said band in relation to said support surfaces as well as the clamping of said band in said holding zone is controlled in synchronization with said mobile knife and a drive thereof.

5. A process according to claim 1, wherein said band is prepared in such a manner that its width substantially corresponds to the distance that separates said lateral supporting surfaces provided for cooperating with its lateral faces, said distance being slightly less than the length of said knives.

6. A process according to claim 1, wherein supports of said fixed and mobile knives of said cutter are cooled and that said knife supports provide large contact surfaces with said knives.

7. An apparatus for feeding a band of fibres in the direction of a fixed knife and a mobile knife of a fibre cutter, comprising:

a mobile support and a mobile plate mounted in parallel spaced apart relation, each having a horizontal support surface substantially parallel to a plane of said band of fibres, said mobile support being substantially U-shaped in cross-section having a base for engaging one of a top and a bottom surface of said band of fibres and first and second lateral supports for engaging lateral surfaces of said band of fibres, the surface area of the support plate and the surface area of the mobile support in contact with the band of fibres being substantially greater than a length of fibres to be cut by the mobile and fixed knives.

means for driving one of said mobile plate and mobile support towards and away from the other of said mobile plate and mobile support and reciprocally towards and away from said fixed and movable knives from a first position, spaced from said knives, to a second position adjacent said knives;

means for driving the other of said mobile plate and said mobile support reciprocally towards and away from said fixed and mobile knives from a first position, spaced from said fixed and mobile knives, to a second position adjacent said knives;

claw means disposed between said mobile support and said knives, said claw means comprising two parallel chucks extending transversely to a longitudinal centerline of said band of fibres, one of said chucks being fixed and being disposed substantially at the same level as an edge of said fixed knife, said band being disposed so as to move horizontally between said two chucks;

means for alternatingly moving the mobile chuck of the claw means in a direction substantially perpendicular to the longitudinal centerline of the band so as to selectively pinched the band between the mobile and stationary chuck; and means for reciprocally driving said mobile knife towards and away from said fixed knife so as to periodically cooperate with said fixed knife to cut fibres therebetween, whereby the mobile support, mobile plate and mobile chuck can be driven in synchrony so that when said mobile plate and said mobile support are each at their first position, said one of said mobile plate and mobile support is moved towards the other to clamp the band therebetween, the mobile chuck is moved away from the stationary chuck, the mobile plate and mobile support are thereafter advanced together from the first positions thereof to the second positions thereof, the mobile chuck moves towards the stationary chuck to clamp the band therebetween, the mobile knife can move to cut the fibres disposed between the mobile knife and the fixed knife while the band is held at a standstill by at least one of said claw means and said mobile plate and support, the one of the mobile plate and mobile support is moved away from the other and the mobile plate and mobile support are returned to their first positions, with the mobile plate and mobile support spaced apart, whereupon the driving process is repeated.

8. A fibre cutter according to claim 7, which comprises means for adjusting the amplitude of said alternating movement of said mobile support as a function of said length of said sections of fibres to be cut.

9. A fibre cutter according to claim 8, wherein said means for adjusting said amplitude of said alternating movement of said mobile support are arranged in such a manner that, if said amplitude has been set, the amplitude is being maintained constant.

10. A fibre cutter according to claim 7, which comprises means for adjusting, respectively, a position of said mobile plate and of said mobile chuck of said claw as a function of the thickness of said band of fibres to be cut.

11. A fibre cutter according to claim 9, wherein said means for adjusting said amplitude of said alternating movement of said mobile support comprise a fixed stop for determining said second position of said support by limiting its travel in said direction of said fixed knife, which travel is caused by a pressure of at least one spring, and an eccentric of an eccentricity, adjustable as a function of said length of said sections of fibres to be cut, provided for acting upon said support against said spring in order to move said mobile support into said first position.

12. A fibre cutter according to claim 9, wherein said means for adjusting said amplitude of said alternating movement of said mobile support comprise two levers hinged symmetrically to said mobile support, in relation to said longitudinal centerline of said band, two fixed stops that are each cooperating with a lever and the position of which is adjustable as a function of said length of said sections of fibres to be cut, against which are applied said levers by springs and two cams that are acting upon said levers, with said stops and said cams located on both sides of said levers, with said stops being located between hinges of said levers on said mobile support and said cams, with further springs provided for maintaining said levers applied against said cams.

13. A fibre cutter according to claim 12, wherein each of said fixed stops includes a roller, an axle of which is being carried by an arm that is able to move in order to adjust the position of said roller, according to a vertical direction under an action of further means such as a micrometer ratchet, with said micrometer ratchets controlling said two arms that are supporting said two stops being coupled together in order to allow for being controlled simultaneously, with said axles of said rollers that constitute said fixed stops being located, in a non-active position of said cams and whatever their position as a function of said length of said sections of fibres to be cut may be, in a plane parallel with a plane that passes through longitudinal centerlines of said levers.

14. A fibre cutter according to claim 7, wherein said mobile support is supported and hinged to ends of rods, the other ends of which are assembled to fixed spindles of axes perpendicular to a direction of displacement of said mobile support, with said mobile plate being suspended and hinged to ends of a first set of rods of which the other ends are hinged, around an axle parallel with said spindles, at a crossbar mobile according to a substantially vertical direction, adjustable in height and arranged above said mobile support and linked to the latter by a second set of rods of axles in parallel with those of said first set, hinged to said plate and to said legs of said U-shape that constitutes said mobile support, with said mobile chuck of said claw supported, at its ends and adjustable in height, by a mobile frame, according to a substantially vertical direction, supported itself by further rods of axles parallel with said spindles and hinged to fixed pivots.

15. A fibre cutter according to claim 7, wherein said mobile support is supported and hinged to ends of rods, the other ends of which are assembled to fixed spindles having axes perpendicular to a direction of displacement of said mobile support, said mobile plate being, on the one hand, suspended and hinged to ends of a set of rods, the other ends of which are hinged around an axle in parallel with said spindles, at a crossbar mobile according to a substantially vertical direction, of adjustable height and arranged above said mobile support and, on the other hand, linked to the latter by a set of deformable parallelograms of axes in parallel with those of said set of rods, with two parallel elements of each of said deformable parallelograms being fitted respectively, perpendicularly to said core of said U-shape and symmetrically in relation to said longitudinal centerline of said band, to one of said legs of said U-shape and to said mobile plate, with said mobile chuck of said claw being supported, at its ends and adjustable in height, by a mobile frame, according to a substantially vertical direction, which is supported itself by further rods of axes in parallel with said spindles, hinged to fixed pivots.

16. A fibre cutter according to claim 14, wherein the movements of said mobile support, of said crossbar that is supporting said mobile plate and of said frame that is supporting said mobile chuck of said claw are being caused, for moving said mobile support from one to the other of said extreme positions, for moving said crossbar in such a manner that said mobile plate is being removed from said band supported by said mobile support and for moving said frame in such a manner that said claw opens, by cams driven in rotation from driving means of said mobile knife, in synchronization with the latter, and acting either upon said levers or upon said mobile support, upon said crossbar and said frame, with said movements of said mobile support, crossbar and frame taking place in an opposite direction, for returning said mobile support into one of said extreme positions, with said mobile plate resting on said band and said claw in closed position, respectively under the action of return springs.

17. A fibre cutter according to claim 7, wherein said supports of said fixed and mobile knives are designed so as to have with the latter large contact surfaces, with said supports being pierced each by at least one channel that extends according to a length of said support and that is designed for allowing a coolant to pass through, with means being provided, for moving said coolant to one of the ends of said channels made in the supports as well as for collecting said coolant and for having circulate, preferably continuously, said coolant through said channels.

18. A fibre cutter according to claim 14, wherein said fixed pivots are adjustable in position according to a direction parallel with said longitudinal centerline of said band in order to be able, to adjust the position of said mobile chuck of said claw in such a manner that it becomes located as close as possible to a trajectory of said mobile knife, in such a manner as to bring said band to a standstill in an immediate neighborhood of said knives and to change the position of said mobile chuck as said fixed knife becomes increasingly worn.

* * * * *